US006390049B1

(12) United States Patent
Sobhani

(10) Patent No.: US 6,390,049 B1
(45) Date of Patent: May 21, 2002

(54) AIR COOLED OIL FREE ENGINE

(76) Inventor: Seyd Mehdi Sobhani, 7704 143 Av. SE, Newcastle, WA (US) 98059

( * ) Notice: Subject to any disclaimer, the term of this patent is extended or adjusted under 35 U.S.C. 154(b) by 0 days.

(21) Appl. No.: 09/589,539

(22) Filed: Jun. 8, 2000

(51) Int. Cl.[7] ..... F02F 1/24; F01L 9/02; F02B 75/32

(52) U.S. Cl. ..... 123/193.1; 123/90.11; 123/90.24; 123/197.3

(58) Field of Search ..... 123/197.3, 193.1, 123/193.4, 193.6, 90.11, 90.24

(56) References Cited

U.S. PATENT DOCUMENTS 1,180,947 A * 4/1916 Scott ..... 123/193.1
1,181,802 A * 5/1916 Rogge ..... 123/193.1
4,111,164 A * 9/1978 Wuerfel ..... 123/197.3
5,782,211 A * 7/1998 Kamimaru ..... 123/90.11

FOREIGN PATENT DOCUMENTS

DE 2601750 * 7/1977

* cited by examiner

*Primary Examiner*—Noah P. Kamen

(57) ABSTRACT

In a conventional internal combustion engine the cylinder wall constrains the connecting rod to a straight up and down motion. The wall of a valve-guide also constrains the valve movement to a straight up and down motion. In ACOFE, two staggered bellows constrain the connecting rod to a semi-straight up and down motion, and therefore eliminate the need for the cylinder. Two other smaller bellows constrain a valve to a semi-straight up and down motion, and therefore eliminate the need for the valve-guide.

9 Claims, 12 Drawing Sheets

Figure 1: Prior Art

AIR COOLED OIL FREE ENGINE

CROSS-REFERENCES

U.S. Pat. No. 4,111,164 Sep. 5, 1978 Wuerfel
U.S. Pat. No. 1,181,802 May 2, 1916 Louis H. R. Rogge
U.S. Pat. No. 1,180,947 Apr. 25, 1916 James F. Scott
U.S. Pat. No. 5,782,211 Jul. 21, 1998 Kamimaru

BACKGROUND

1. Technical Field

ACOFE is a reciprocating internal combustion engine, which operates under almost identical conventional strokes.

2. Background Art

The core novelty of ACOFE is the elimination of the sliding surfaces inside the combustion chamber, inside the intake and exhaust valve guides, and the sliding surfaces of the intake and exhaust valve stems on their corresponding cams. By using the concept of bellows, the inventions U.S. Pat. Nos. 1,181,802 and 1,180,947 have been able to shift the internal sliding surfaces associated with piston and cylinder to an external one. But neither of these prior inventions has been able to eliminate the need for the supporting sliding surface of the cylinder. ACOFE, however, has introduced an ingenious two-bellows structure to suspend the top end of the connecting rod, and completely eliminate the need for a supporting sliding surface. ACOFE uses the same ingenious two bellows structure to suspend the valves of the engine, and by doing so the need for the supporting surfaces of the valve-guides is eliminated. The invention U.S. Pat. No. 5,782,211 has used the concept of solenoid to eliminate the cams. But as is clearly shown in its diagrams, U.S. Pat. No. 5,782,211 still needs the supporting sliding surfaces of the valve-guides. The invention U.S. Pat. No. 5,782,211 has used two separate electric coils for each valve: the first moving coil is the armature that is fastened to the valve-stem, and the second coil is the solenoid, which is stationary. The electromechanical valves in ACOFE do not need armature, each valve system uses only one stationary coil to drive the valve body. The elimination of the armature and the valve-guide in ACOFE allows the weight of the valve to be dramatically reduced, allowing each valve operate at a much higher frequency than what is conventionally possible. In ACOFE a connecting rod is introduced that slightly bends, but do not compress or expand. ACOFE's connecting rod is different in structure and purpose than the connecting rod in the invention U.S. Pat. No. 4,111,164. The structure of ACOFE's connecting rod is almost identical to the conventional connecting rod, while U.S Pat. No. 4,111,164 changes the structure completely into a helical spring. The purpose of ACOFE's connecting rod is to eliminate the joint at the top end of the connecting rod, while the purpose of U.S. Pat. No. 4,111,164 is to create a variable volume. The maximum chamber volume in ACOFE is fixed.

BRIEF SUMMARY OF THE INVENTION

ACOFE is a reciprocating internal combustion engine that operates without the need of oil or antifreeze. The elimination of friction is equivalent to the elimination of some energy loss. Moreover, the contact sliding of piston rings in conventional engines scrapes off any coating that might be applied to the internal surfaces to retard heat transfer, but in ACOFE the coating of the internal surfaces would stay intact retarding heat transfer and producing better efficiency.

BRIEF DESCRIPTION OF THE DRAWINGS

For the purpose of background and reference, a conventional piston and cylinder engine is depicted in FIG. 1.

DETAILED DESCRIPTION OF THE ACOFE

Figure 1:
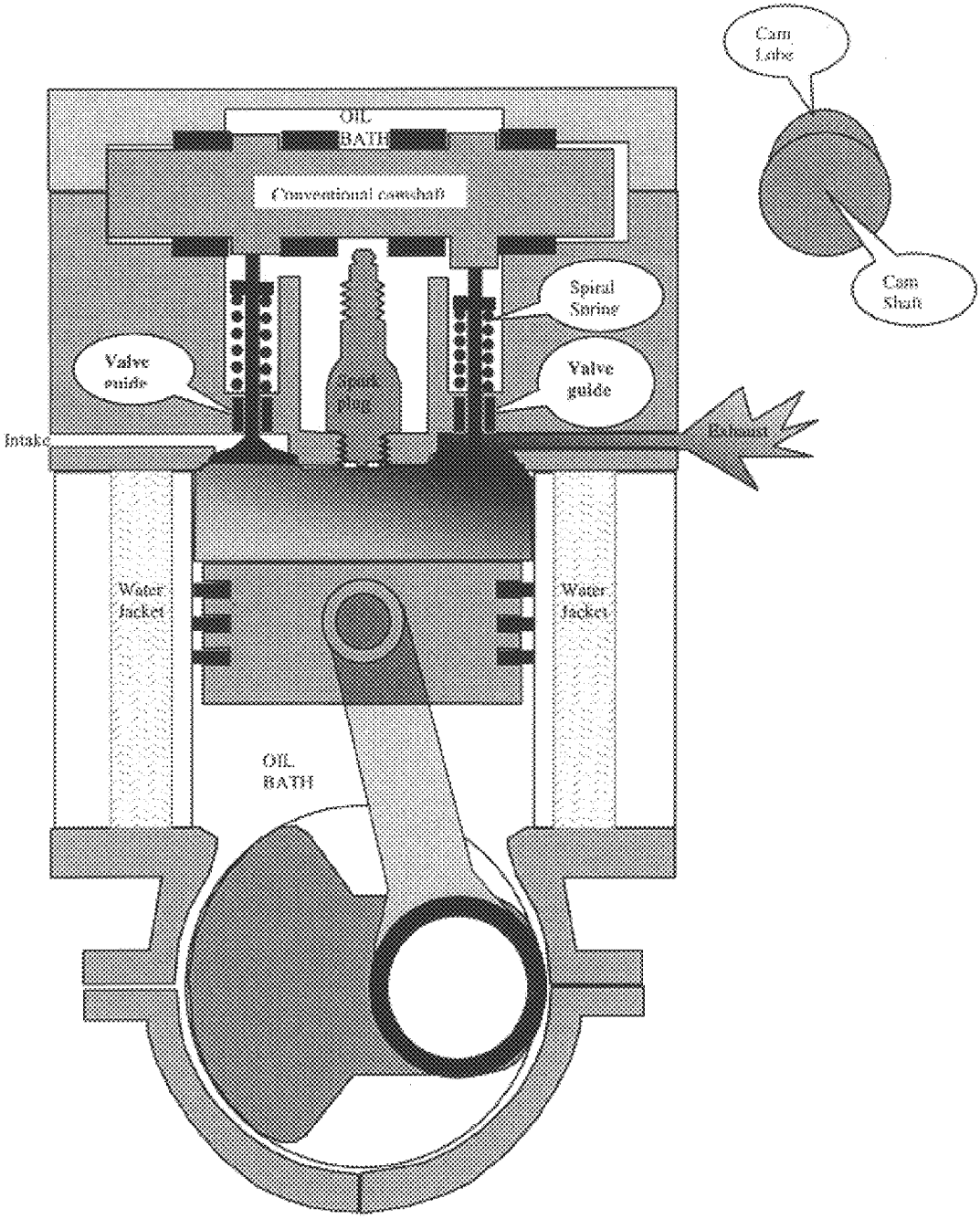
Figure 2:
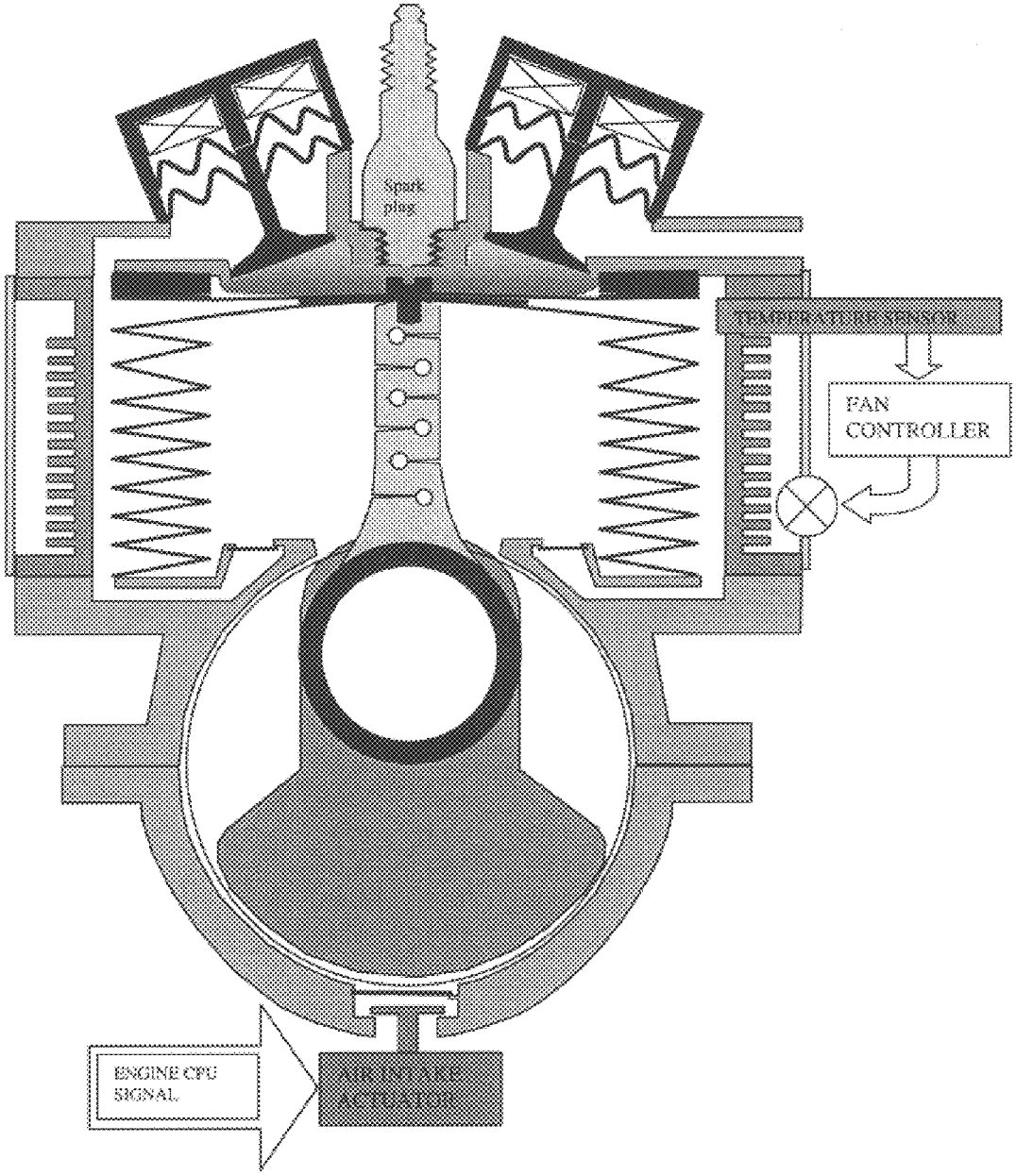
FIGS. 2, 3, & 4 depict three sequential snapshots of the ACOFE from the beginning to the end of the power stroke.
Figure 3:
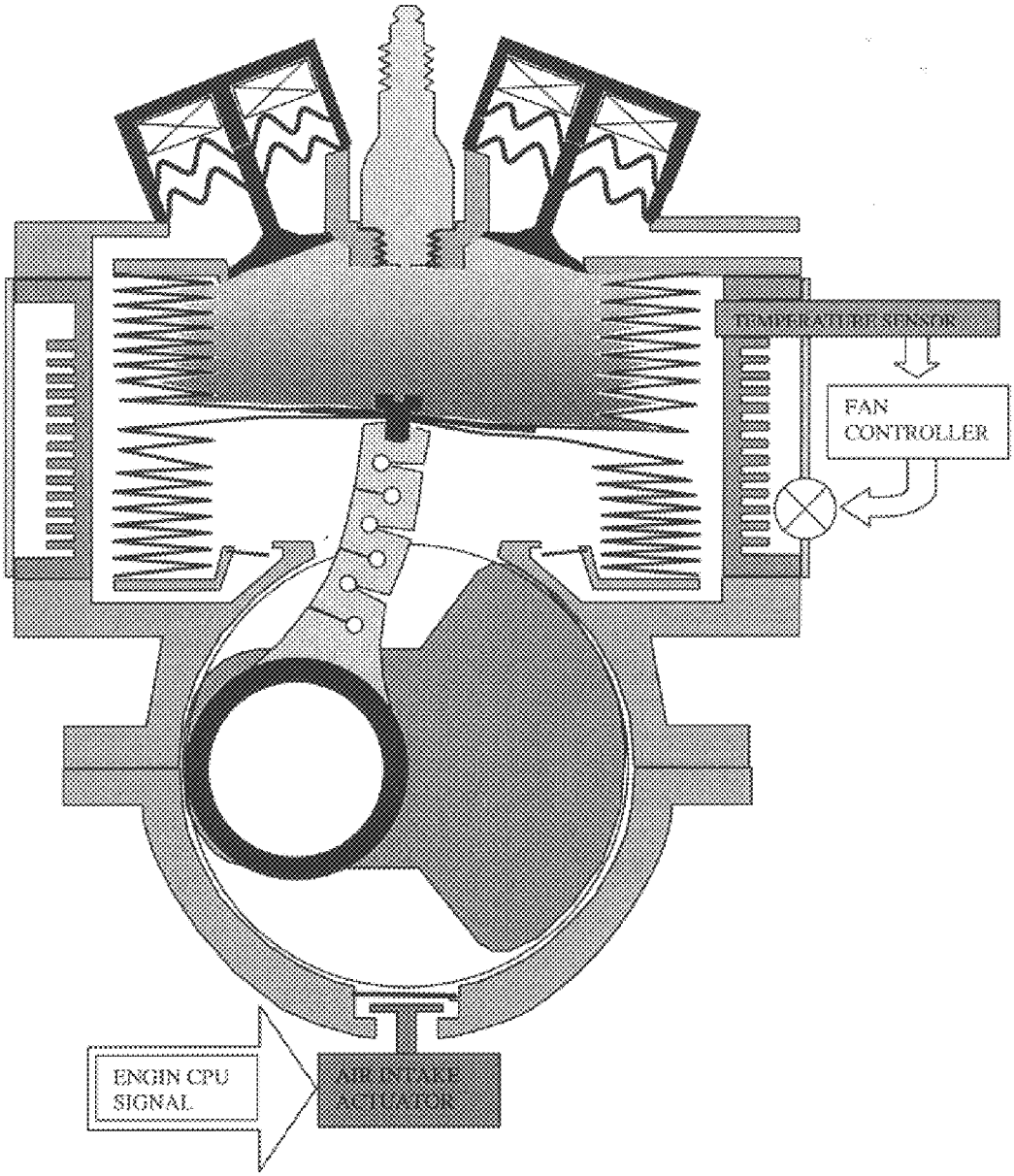
Figure 4:
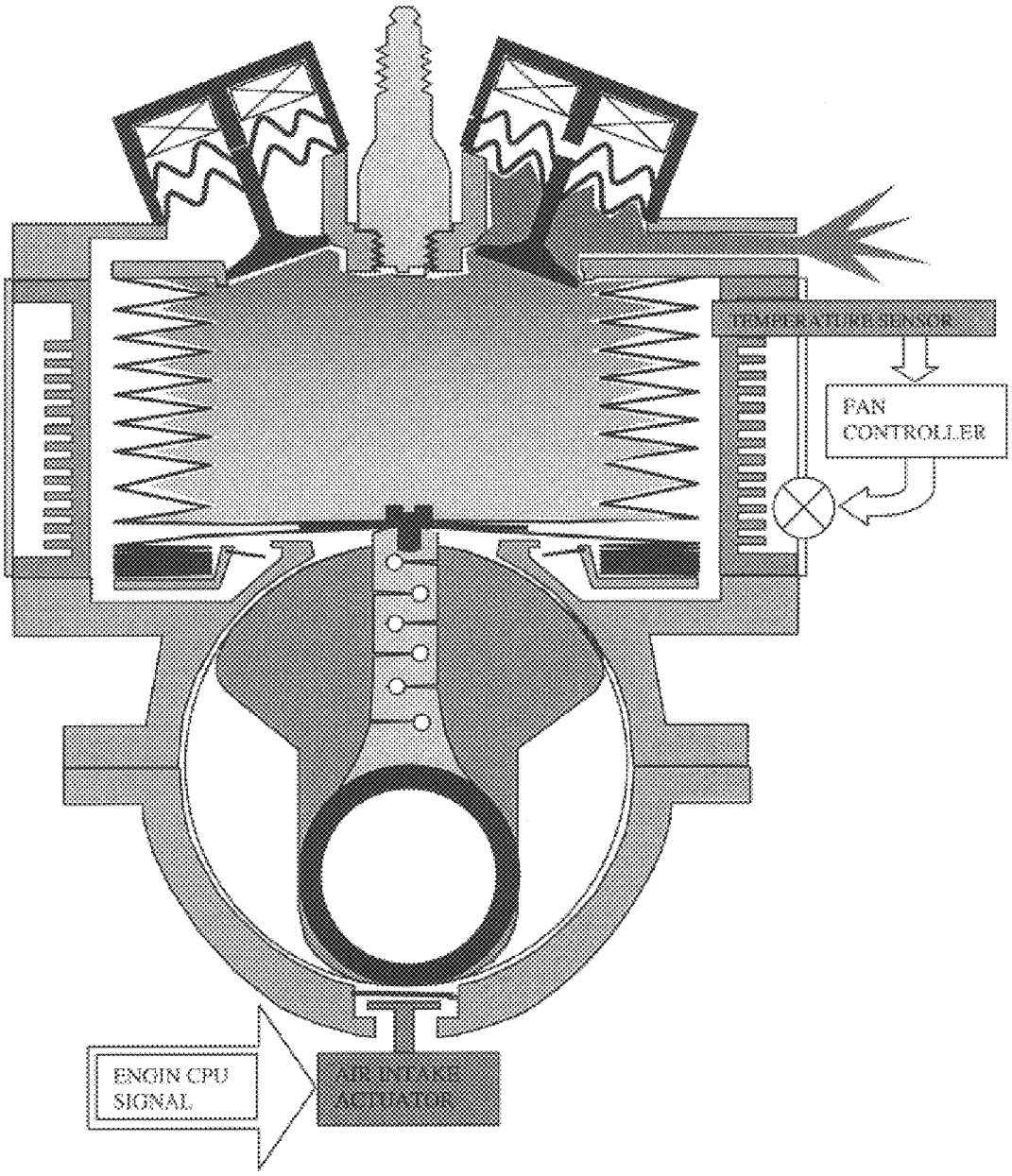
Figure 5:
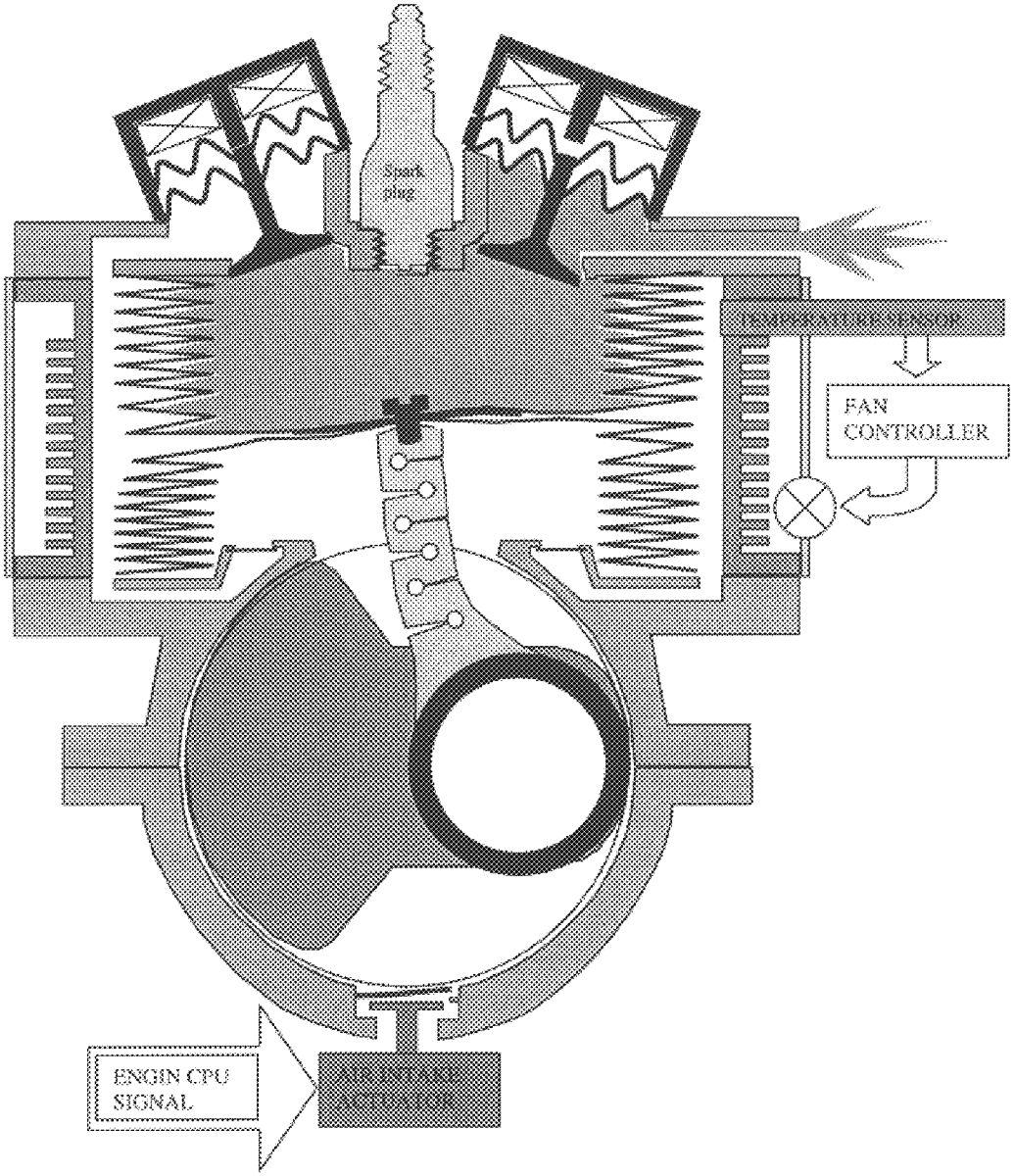
FIG. 5 depicts the ACOFE in the middle of exhaust stroke.

Conventional piston and cylinder structure: FIG. 1 depicts the conventional piston and cylinder combustion engine. A piston is placed into a cylinder-block to form a sealed chamber via a series of piston rings. To reduce the sliding friction between these rings and the cylinder wall continuous oil lubrication is required. Intake and exhaust valves access this chamber through the head of the engine. These valves are mechanically coupled to the main crankshaft via an assembly of camshafts and timing chain or belt. Spiral spring is used to force a valve closed at all times. A cam (on the camshaft) is designed to overcome the spring force and accelerate the valve toward its open state. The sliding of the valve-stems on the cams and on the walls of the valve-guides must take place in a bath of oil. To remove the concentrated heat, (from combustion and friction) a good heat capacity media like water is required. The water has to flow through the water jacket to carry the generated heat to the many thin surfaces of the radiator. The many surfaces of the radiator will eventually dissipate the generated heat to the atmosphere.

A major contributor of water pollution is the oil that leaks from cars. Also, the minute amount of oil that burns inside each combustion chamber pollutes the air with carcinogenic byproducts. The burning of the oil will also gum up the piston rings, the valves' rims, and the valve seats. Another source of water pollution is antifreeze. The friction produced by the sliding of the piston rings and the valve system robs a considerable percentage of work from the crankshaft. Therefore an engine without friction that does not need oil and water is environmentally friendly and economically desirable. ACOFE is such one, and as shall be show this engine will also be cheaper to manufacture.

Figure 6:
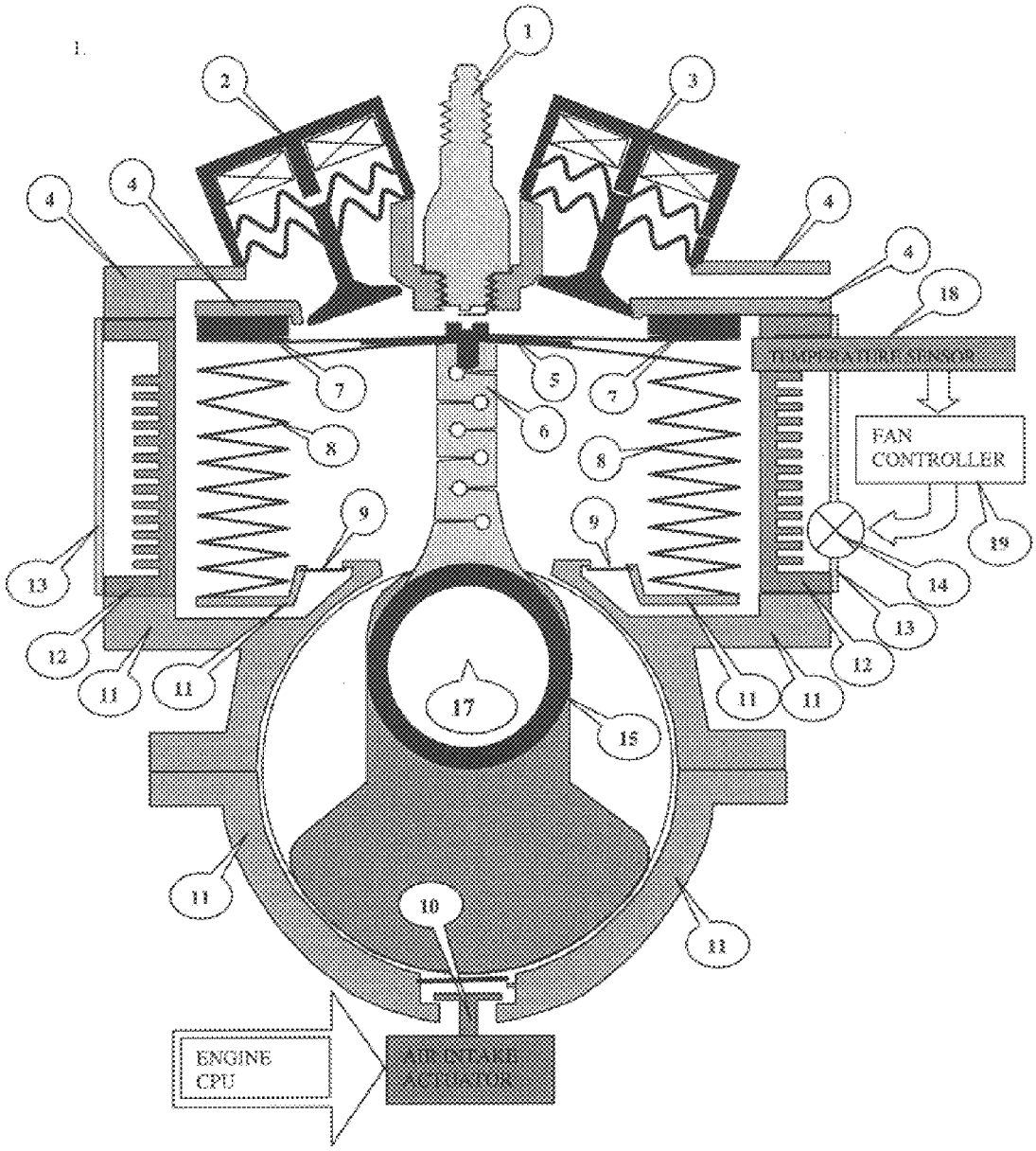
FIGS. 6 and 7 are for the purpose of naming and numbering of the engine components.
Figure 7:
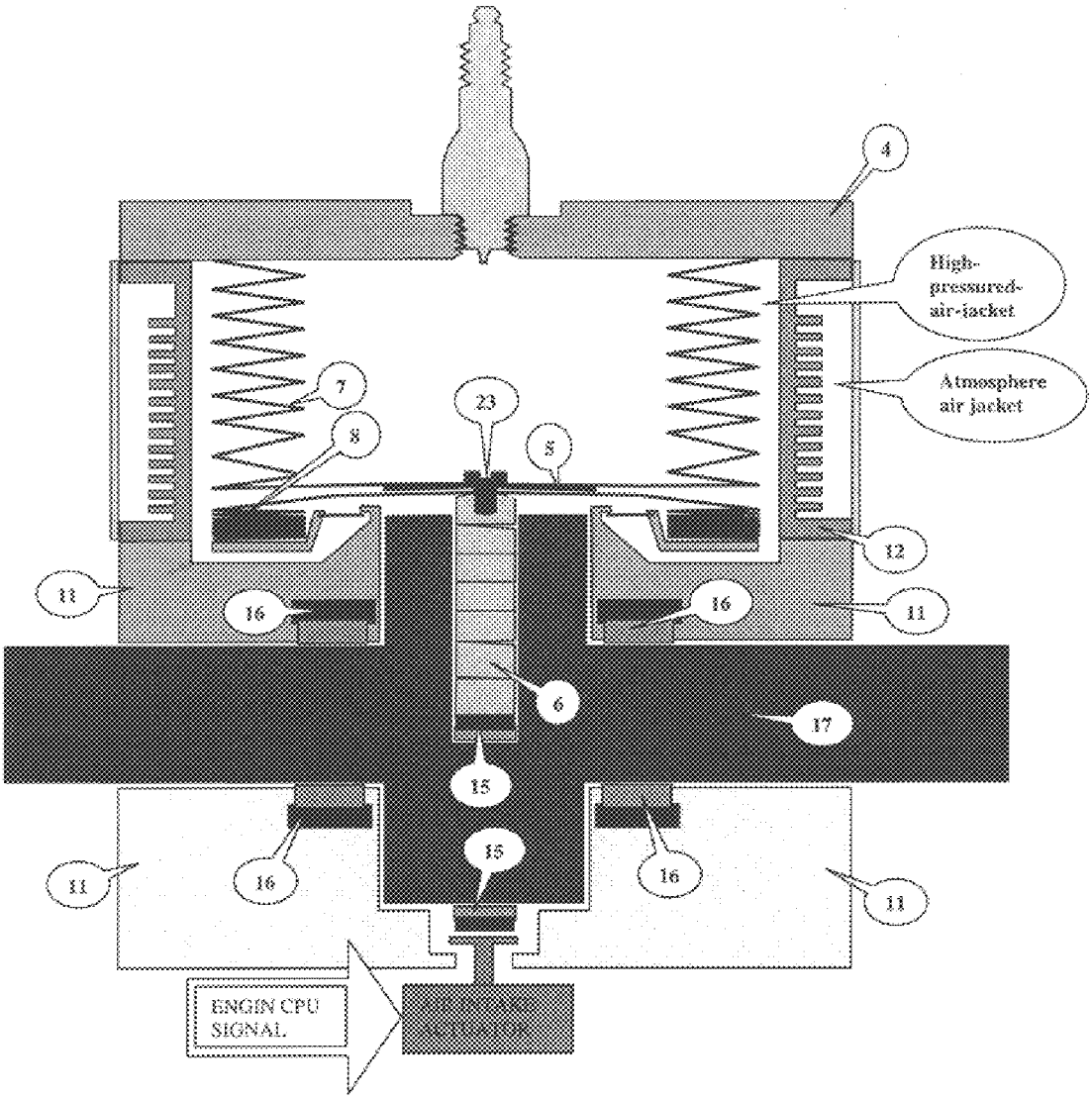

ACOFE Structure: The same conventional strokes that normally take place inside the conventional piston and cylinder engine would now take place inside the bellows-chamber of the ACOFE. FIGS. 6 and 7 depict ACOFE at TDC and BDC. The top end of the top bellows (7) is sealed to the head (4) to form the combustion chamber. The bottom end of the bottom bellows (8) is sealed to the crankcase (11). The bottom end of the top bellows and the top end of the bottom bellows are free to move. The screw (24) ties the two free ends of the two bellows (7 & 8) to the suspension disk (5) and the top end of the connecting-rod (6). The structure of these two bellows, in the mentioned fashion, constrains the top end of the connecting rod to move up and down in an almost straight vertical line. As will be shown this up and down motion really takes place in a narrow vertical elliptical shape. The bottom bellows (8) was introduced into this invention to stop the top end of the connecting-rod (5) from lateral diversion and to provide an air pumping chamber.

Figure 9:
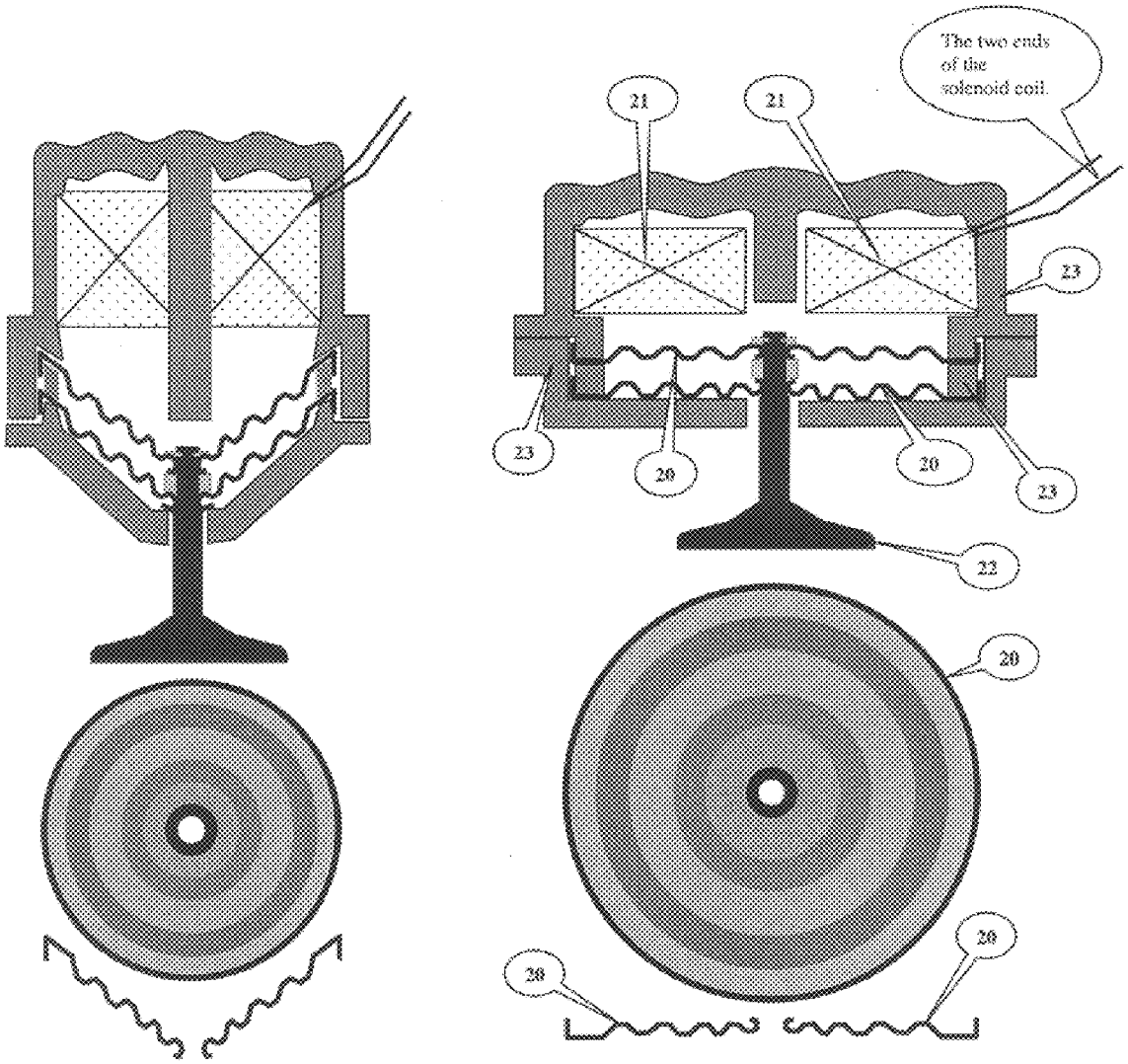
FIG. 9 depicts the structure of intake or exhaust valve as a stand-alone invention.

High Frequency Valve Structure: FIG. 9 proposes a new electromechanical valve, which requires no valve guide and therefore no lubrication. Each valve requires only one stationary coil and no armature. This valve by itself is a stand-alone invention and could also be used in the conventional engines and compressors.

The stem of the valve (22) is secured to the middle of two bellows-springs (20) at two different places. The outside perimeter of each bellows-spring is secured to the valve chassis (23). This would constraint the valve to move in a straight line and therefore eliminate the need for a valve guide. The springs in the conventional valves force the valve to close. But the bellows-springs, here, force the valve to open. The role reversal of the spring force was introduced in order to simplify the electromagnetic hardware that should produce the needed electromagnetic force. One stationary electric coil or salenoid (21) is used to force the valve to close. No moving armature coil is required. The magnetic flux path is through the valve chassis (23), the valve stem, and also through the bellows-springs. The two bellows-springs would also function as fins to transfer heat away from the valve stem.

Smooth Valve Transition: When the engine revolves at 12000 rpm, its frequency is 12000 rpm/60=200 Hz. In a four stroke engine each valve operates at half the engine frequency, 100 Hz. FIG. 15 shows the coil driver electric circuit. In this figure E is a 48-volt battery that would energize the coil. A single power transistor M is used to control electric power to this coil. In a conventional valve, a cam smoothly closes and opens the valve, (the valves don't collide with their seats). To force a similar smooth valve operation, (from open to close, or from closed to open) the power transistor (M) shall be switched on and off at a much higher rate than the valve itself, (M would switch at 10 KHz to 50 KHz, which is much higher than the maximum frequency of the valve itself, 100 Hz). The pulse width of the M switching shall be modulated to induce a desired smooth valve transition, (pulse width or duty-cycle of the switch M is defined as, D=[(Time On)/(Period)] 100%.). When the coil is not energized, the bellows-springs will force the valve to stay at its open position. The valve is commanded to close by initially applying maximum duty cycle of D=100% to the switch M. The electromagnetic force will overcome the bellows-springs and will accelerate the valve toward its closed position. Just before the valve collides with its seat, the duty cycle of the switch M shall be reduced dramatically, D=0%. At this time the springs will decelerate the valve until it comes to stop ideally at its closed position. If left alone, the springs will begin to accelerate the valve back towards its open state. But at this time a small duty cycle shall be reapplied to the switch M to overcome the springs and keep the valve at its closed position. A similar profile of duty cycle modulation shall be used to open the valve smoothly. For all operating conditions the parameters that the valve transition depends on do not change (m, k, E, etc.). Therefore the profile by which the duty cycle needs to modulate also does not need to change. This is to say for a smooth valve transition there would be no need for position feedback of the valve. In other words weather the engine revolves at 500 rpm or 12000 rpm the same profile of duty cycle modulation will produce a smooth valve transition. For ideal valve operation (zero coil resistance, negligible circuit loss, & smooth valve transition), the opening and closing of the valve take place without loss of energy. That is to say, ideally the energy stored in the bellows-springs while it was closed will be completely recovered by the circuit while the valve opens again. However, to drive one valve with the mentioned typical parameters, the current simulation predicts 50 watts of electric power will be lost. For simplicity only two valves per chamber is shown in the following figures. An optimum engine design provides four valves per chamber. Therefore a four-chamber engine requires 16 valves. To drive these sixteen valves, the simulation shows 800 watts of electric power are needed. The proposed electric circuit can be further optimized to reduce the loss. Because of the mechanical simplicity of the invention, only 8 transistors are required to control the intake and exhaust valves of a 16-valve, four-chamber/cylinder engine. That is, one switch will control the two intake valves, and one switch will control the two exhaust valves of each chamber/cylinder.

Connecting Rod: The efficiency of the combustion is proportional to its peak temperature. Oil looses its lubrication capability at relatively low temperature. Because of this constraint, an engine that needs lubrication has to operate inefficiently. To remove lubrication requirement from the vicinity of the combustion chamber, it is desirable to eliminate the hinging of the top end of the connecting rod to the suspension disk. In ACOFE the connecting rod is designed by a zig-zag configuration to bend slightly so that the hinging of its top end would not require lubrication. Besides the axial and lateral flexibility, each bellows can also bend in angular fashion. This would reduce or eliminate the amount that the connecting rod has to bend. The combustion chamber in ACOFE is free of any sliding surface. Therefore, its interior could be coated with ceramic, allowing a higher combustion temperature and therefore higher efficiency. The revolving bearing (15) connects the lower end of the connecting rod (5) to the crankshaft (17). Grease rather than oil, shall lubricate the revolving bearing (15) and the two stationary bearings (16). These bearings are far away from the combustion chamber and could easily be kept cool at a desired temperature. The spark-plug (1) is placed inside the head (4) in almost exactly same manner as in the conventional engines. Its operation is also identical to the operation of the spark plug in the conventional piston and cylinder engines.

ACOFE Operation: In each cycle the lower bellows (8) will pump air into the air passage around the two bellows. A simple flap-valve (9) seals off the high-pressured-air-jacket from the atmosphere. The air-intake-valve and the air-intake-actuator (10) will control the average pressure of the high-pressured-air-jacket. To control the average temperature of the air pressure or jacket, a secondary air jacket called atmosphere-air-jacket is introduced. The function of the atmosphere air jacket is to keep the high-pressure air-jacket at a desired temperature. This atmosphere-air-jacket is formed between the engine case (12) and the heat insulator (13). The function of the heat insulator (13), the temperature sensor (18), the fan controller (19), and the fan (14) system is to induce a desired average temperature to the atmosphere-air-jacket by circulating cooling air. The control of the temperature of the atmosphere-air-jacket will in turn controls the temperature of the high-pressured-air-jacket, the combustion chamber, and most other components of the engine.

For every one time that the top bellows (7) removes air from the high-pressured-air-jacket, the bottom bellows (8) will fill this air-jacket twice. Therefore relatively high pressures could be induced into the high-pressured-air-jacket, (close to two atmospheres). During the intake stroke, when the intake valve (2) is commanded open, the air from the high-pressured-air-jacket will flow into the combustion chamber defined by the top bellows. After compression stroke, this air will then burn during the power stroke. During the exhaust stroke, when the exhaust valve is commanded open, the upper bellows (7) will force the hot burned-up air back into the atmosphere.

Valve Equations: To design a valve system, proposed in the ACOFE, that would meet a particular sets of constraints, the differential equations that govern the motion of the valve are needed.

The elimination of the valve guide and the application of the bellows-springs allow the valve stem to be much shorter than the conventional valves. Other than its shorter stem, the physical structure of the valve is identical to the conventional ones. This shorter valve is also much lighter, and since the spring constant must be designed proportional to the mass of the valve, the bellows-springs constant is much smaller than the spring constant of the conventional valves. The following system of two nonlinear differential equations are derived to study the motion of the valve:

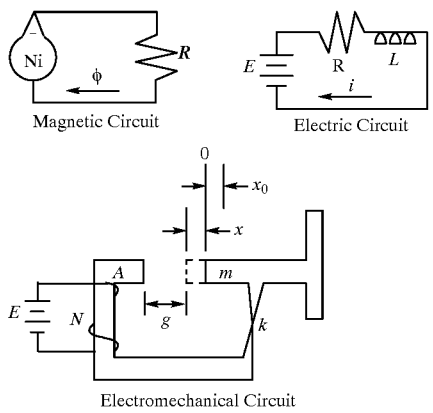

$$\mu AN^2 i^2/m(g-x)^2 - k(x_0+x)/m - P\dot{x}/m = \ddot{x}$$
$$E(g-x)/A\mu N - Ri(g-x)/A\mu N - i\dot{x}/(g-x) = \dot{i}$$

Applying Ohm's law to the electric circuit shown above yields the equation:

$$E - iR = \partial\phi/\partial t, \text{ Where } \phi = \mu ANi/(g-x).$$

Applying Newton's Law to the mechanical circuit shown above yields the equation:

$$F - k(x_0+x) - p\dot{x} = m\ddot{x}$$

Where F is electromagnetic force & $k(x_0+x)$ is spring force.

Applying Ohm's law to the magnetic circuit shown above yields equation:

$$Ni = \Re\phi$$

Where reluctance $\Re = (g-x)/\mu A$.

Inductance, of the coil is a function of x:

$$L(x) = N^2/\Re = \mu AN^2/(g-x).$$

Energy stored in the coil is:

$$W = \frac{Li^2}{2} = \frac{\mu AN^2 i^2}{2(g-x)}.$$

Force is defined, $$F = \frac{\partial W}{\partial x}$$

Therefore $$F = \frac{\mu AN^2 i^2}{(g-x)^2}$$

The following system of two nonlinear second order differential equations is achieved by substitution of the derived equations. They govern the motion of the valve.

Figure 10:
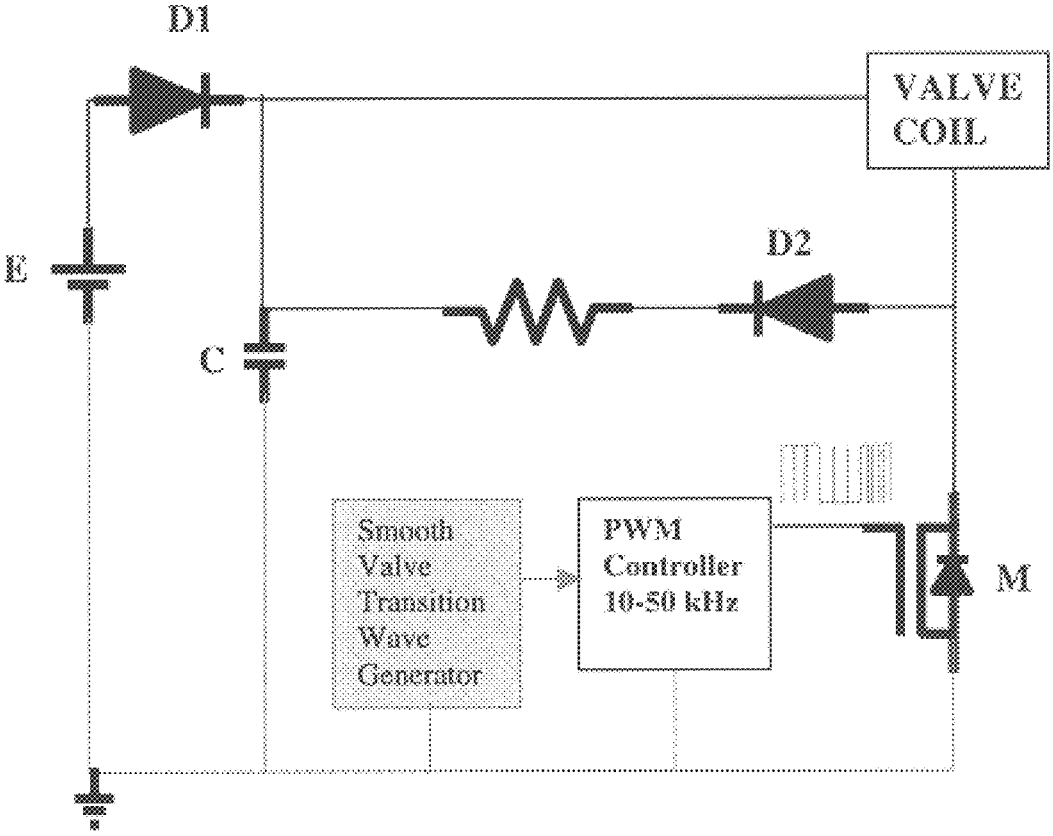
FIG. 10 depicts a top-level schematic of the coil driver circuit.
Figure 11:
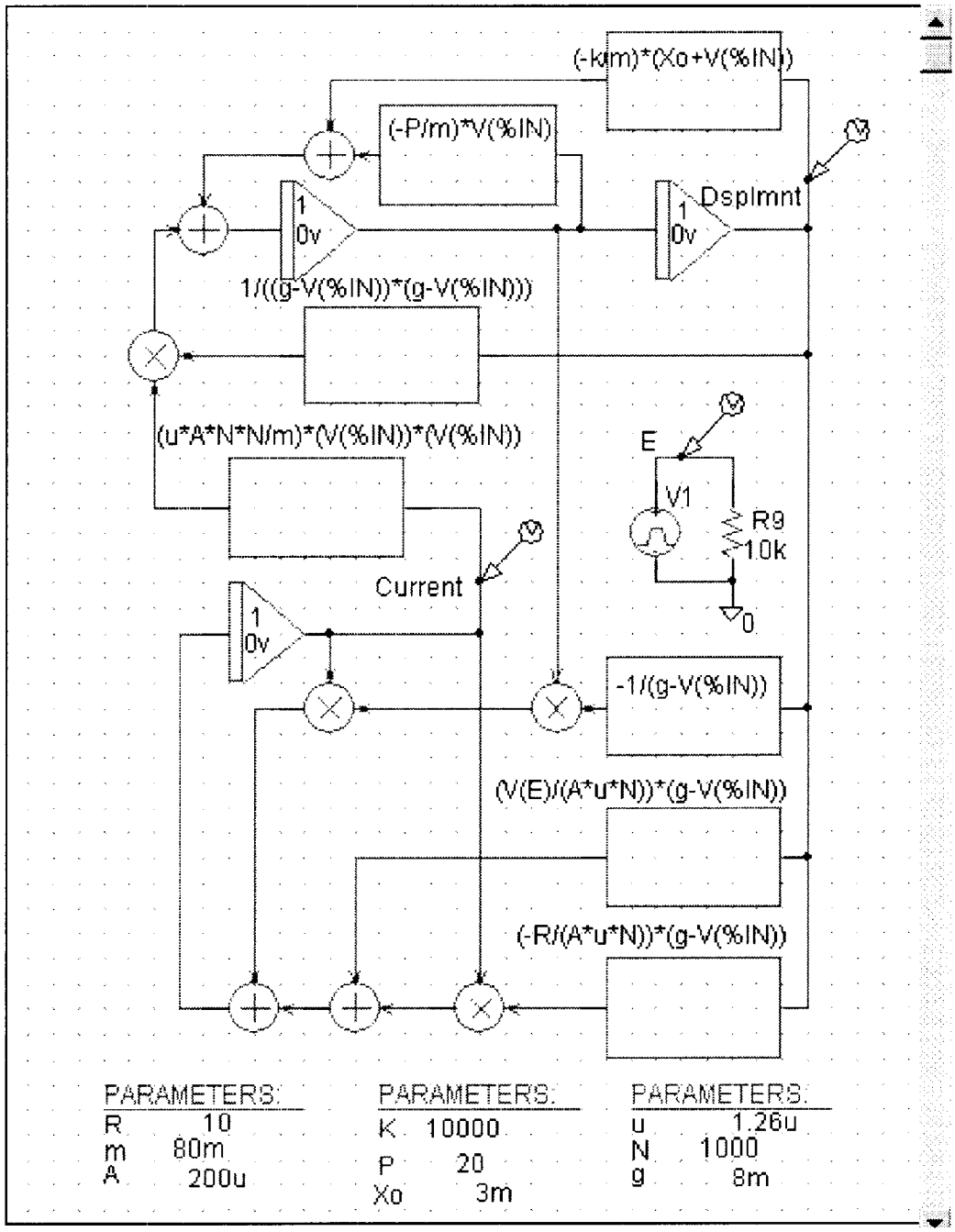
FIG. 11 depicts a simulation circuit that would solve the two nonlinear differential equations, governing the dynamic of the valve.
Figure 12:
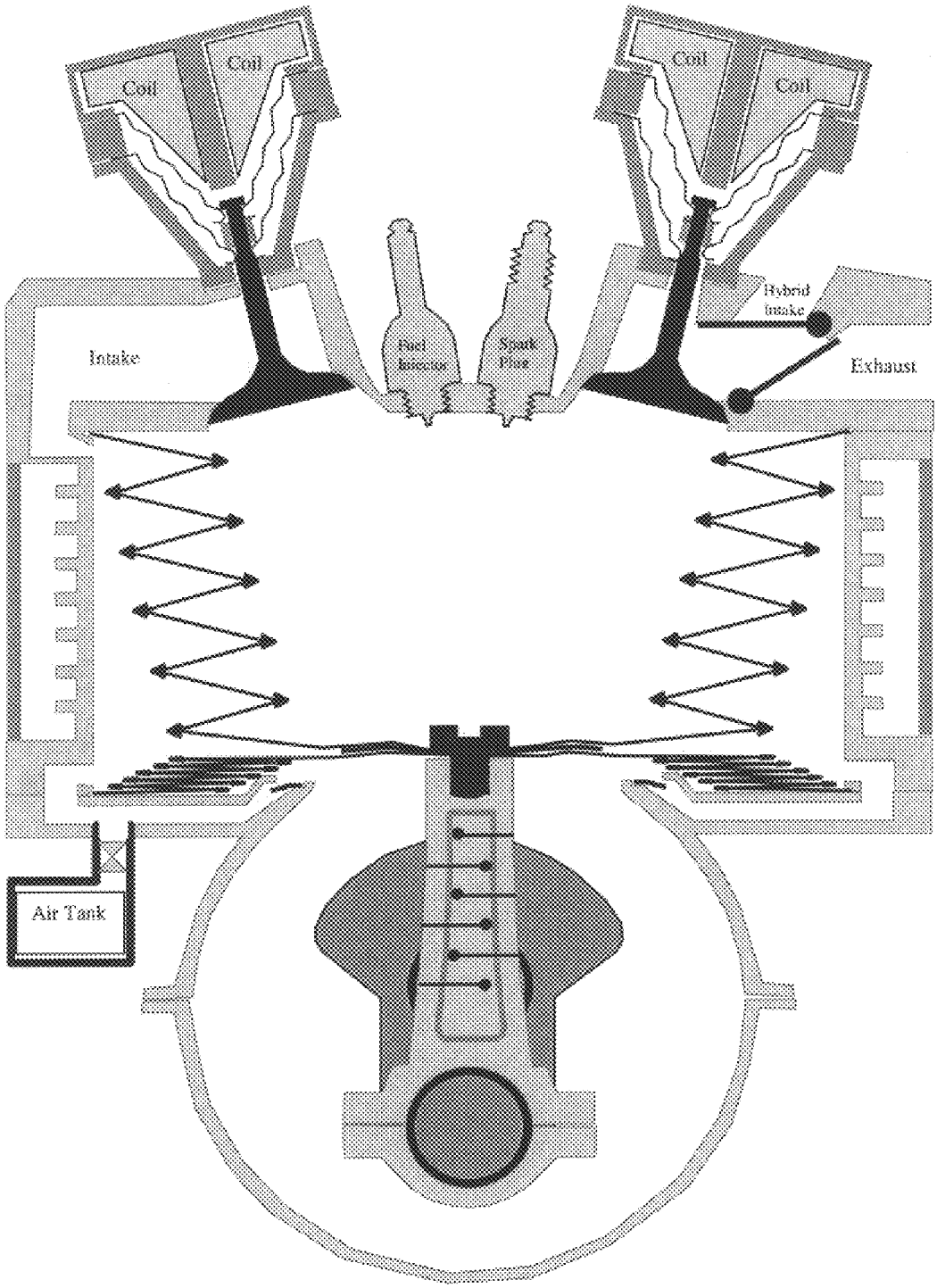
FIG. 12 depicts a realistic drawing of an ACOFE design.

FIG. 10 is a representation of this system of differential equation for simulation. It tells a computer to solve the system numerically, and helps an engineer to design a valve according to a particular set of requirements. Time is the independent variable. The dependent variables are x and i.

Where

E is the battery voltage. For a good valve response a 48 volts battery is needed.

R is the coil resistance. This is the only lossy element in this system. The larger the diameter of the wire the coil the smaller the R. A typical value for this parameter is about R=2 ohms.

i is the instantaneous current in the coil.

N is the number of turns in the coil. A typical value for this parameter is N=1000 turns.

A is the cross section of the magnetic path. Typical value is $A=200*10^{-6}$ meter$^2$.

$\mu$ is the permeability of free space, $\mu=1.26*10^{-6}$ henry per meter.

m is the mass of the valve. A typical value for this parameter is m=80 grams.

k is the spring constant. A typical value for this parameter is k=10000 newton/meter x is the instantaneous position of the valve.

$x_0$ is the initial displacement of the spring from its equilibrium position. Typical value is $x_0=2*10^{-3}$ meter.

P is the dashpot constant produced by the resistance of the air to the valve motion. This is also lossy but this loss is negligible.

Lateral Displacement of The Suspension Disks: The lateral displacement of the top end of the connecting-rod is one of the design parameters that have to be considered. The following simple analysis shows how one can estimates its value.

The peak pressure inside a gas combustion chamber is produced right after ignition, when the system is near TDC. In an automobile engine, this peak pressure is between 500 to 700 PSI.

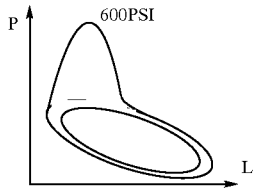

This figure shows a four-stroke engine pressure-volume profile.

The geometry of the system suggests that when the suspension disk is near half way between TDC and BDC (at extreme right or extreme left), it would exert maximum lateral displacements, (force) to the two bellows (7 & 8). The compression ratio is typically about ten to one. Based on the ideal gas law the internal pressure at the extreme right or the extreme left has dropped to one fifth of its peak value (the volume is now 5 times bigger than when it was at TDC). Therefore the peak internal pressure at extreme right or left is 600/5=120 PSI.

The effective cross section of bellows suitable for this invention is about 3.14*(1.5)^2=7.1 square in.

The axial force on the suspension disk at this time is equal to (7.1 square in.)*(120 PSI)=852 lb.

An estimated angle between the connecting rod and the axial direction at this time is about 6.5 degrees.

The lateral force is therefore equal to (852lb.)*Tan(6.5 degree)=187.7 lb.=187.7×4.448=834.7 Nt. As was mentioned before, peak pressure inside the conventional engines is about 600 PSI. In the conventional piston and cylinder engines, typically the hottest components are the exhaust valves, and their peak temperature is about 500 degree Fahrenheit. Therefore bellows rated at 600 PSI & 500° F. (4137000 Nt./m$^2$& 260° C.) will function fine for this invention. Consider the bellows in Palatine catalog. On page 16 of this catalog bellows are rated up to193BAR & 350° C. (19300000 Nt./m$^2$ & 350° C.) which will stand the mechanical and thermal stresses of this invention with considerable margin. The model number 104-25/, with ID=104.14 mm & OD=152.40 mm, has the lateral spring rate of: K=269.30 N/mm.

Therefore for this bellows the lateral displacement of the suspension disk is, (834.7)/(269.30)=3.10 mm.

The stroke of the engine is about 70 mm.

RADIATOR: As was mentioned before, the concentration of heat in the conventional piston and cylinder engine requires a high heat capacity media, (water) to remove the heat from the concentrated areas and deliver it to the atmosphere through the many thin surfaces provide by the radiator. In the ACOFE the bellows themselves function as radiator to deliver the heat directly to atmosphere. Also, because of the lack of friction, in the combustion chamber and in the valves, less heat needs to be dissipated.

Bellows Volume: To design a desired compression ratio a formula is needed that would calculated the volume of the bellows. If n diaphragms of thickness t are used in the fabrication of a bellows, and if each diaphragms deflects by ($\epsilon$), then the length of the bellows is L=n$\epsilon$+nt. A good estimate of the volume may be derived if we assume a conical deflection for each diaphragm of the bellows. By symmetry, each diaphragm would contribute the same amount to the total volume.

The following figure is a model of a bellows that has expanded, as each of its diaphragms has followed a hypothetical conical expansion. For the sake of derivation only one diaphragm is shows in the lower figure.

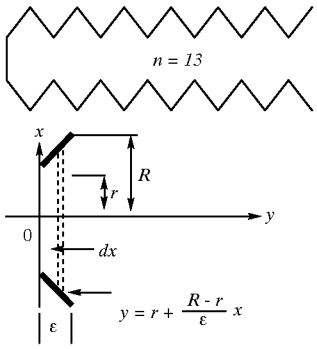

By revolving the function $$y = r + \frac{R-r}{\varepsilon}x$$

about the x axis the volume of the cone section created by one diaphragm can be calculated:

$$dv_1 = \pi y^2 dx$$

$$v_1 = \pi \int_0^{\varepsilon} y^2 dx$$

$$v_1 = \pi \int_0^{\varepsilon} \left( r^2 + \left(\frac{R-r}{\varepsilon}\right)^2 x^2 + \frac{2r(R-r)}{\varepsilon} x \right) dx$$

$$v_1 = \pi \left[ r^2 x + \frac{(R-r)^2}{3\varepsilon^2} x^3 + \frac{r(R-r)}{\varepsilon} x^2 \right]_0^{\varepsilon}$$

$$v_1 = \frac{\pi}{3}(R^2 + r^2 + Rr)\varepsilon \quad \text{volume generated by one diaphragm.}$$

$$v_n = \frac{\pi}{3}(R^2 + r^2 + Rr)n\varepsilon$$

$$\boxed{v_n = \frac{\pi}{3}(R^2 + r^2 + Rr)n\varepsilon}$$

Volume of a bellows fabricated with $n$ diaphragms.

High Frequency Actuator-Bellows: Bellows in the market today are designed as pipe joints. Their specified operation, at best, is one cycle every minute. They are designed to operate in the plastic region. ACOFE requires bellows that would function as high frequency actuators. The desired life of an automobile engine is for 200000 miles during which the bellows have to operate about one billion cycles. They have to operate at the rate of five thousand-RPM. Such actuator-bellows do not exist in the world today. Therefore they have to be invented.

The following points have to be recognized in order to help invent the high frequency actuator.

1. The pressure of the fluid in pipes could stay low and constant for a long time. Therefore leakage, (rather than stress and fatigue) takes precedence over all the other parameters of pipejoints. Constant cross section is the next important parameter for pipe-joints.
2. The pressure in the actuators for ACOFE periodically changes with high frequency. Therefore stress and fatigue have precedence over all the other parameters of the design. Certain amount of leakage, (0.01%) shall be tolerated in order to elevate stress and fatigue. The conventional valves, which should ideally function like a switch, in fact leak through a good percentage of the engine cycle. Leakage also exists around the conventional piston rings. Therefore the allocation of a small amount of leakage, in the bellows, should not sound disturbing. Constant cross section is not important in the desired actuator-bellows.

3. Next to stress and fatigue, the natural frequency of the actuator-bellows is of utmost importance in ACOFE. The natural frequency of the actuator-bellows in ACOFE is $\omega=2\sqrt{3}\ k/m$, where k is the spring constant and m is the mass of each actuator-bellows.

Plan for Inventing High Frequency Actuator-bellows

Figure 8:
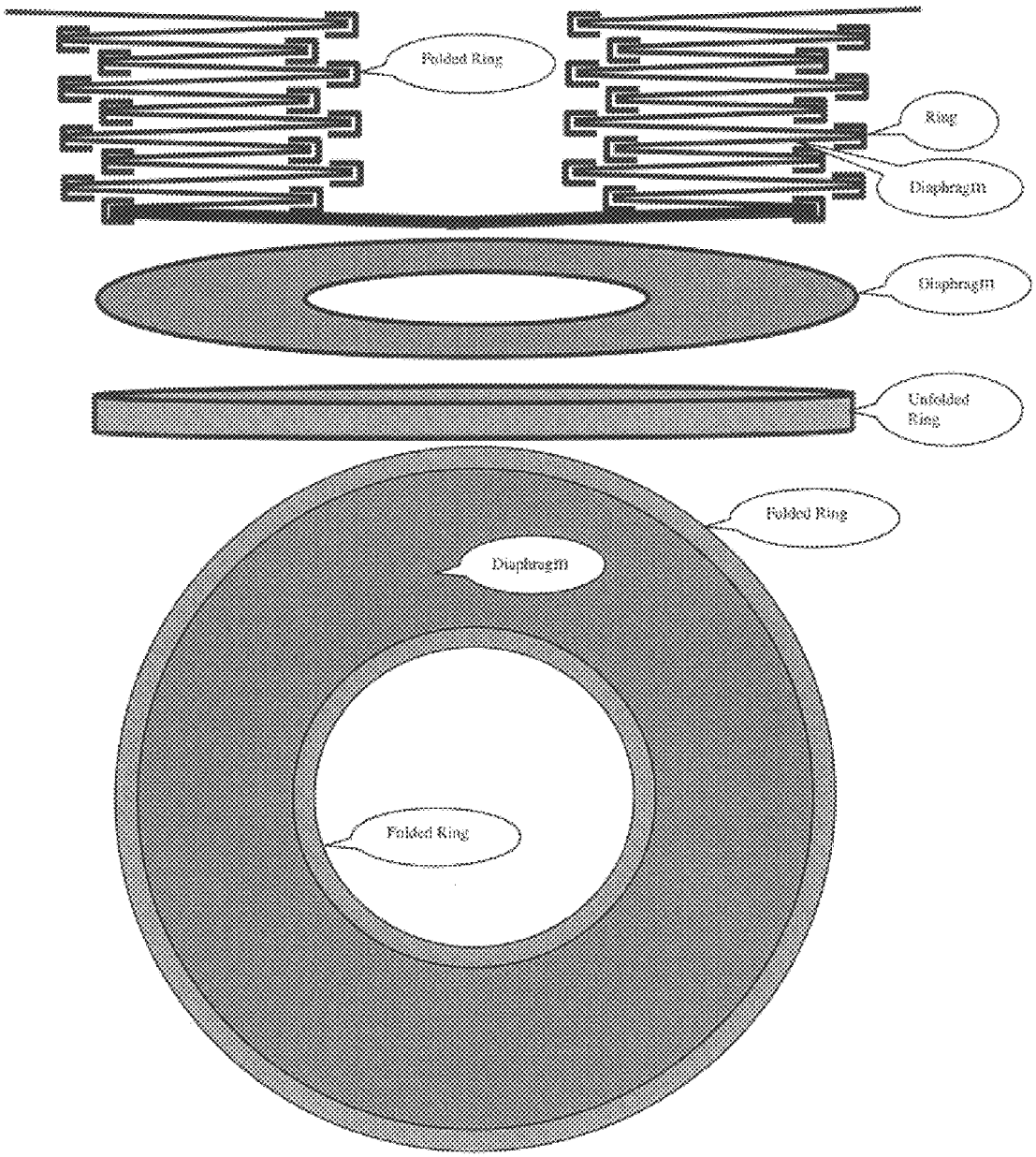
FIG. 8 depicts how a mechanically fabricated bellows produces a lower stress actuator-bellows than a welded one.

1. The highest stress is developed at the seams of a bellows, where the diaphragms are conventionally welded together. To dramatically reduce the stress at these seams, weld shall not be used. Instead of weld these diaphragms will be mechanically locked together as shown in the FIG. 8.
2. At 6000 rpm the engine's frequency is 100 Hz. To be able to respond to this frequency the natural frequency of the actuator-bellows should be about 1000 Hz. In order to accomplish an actuator-bellows design with high natural frequency $\omega=2\sqrt{3}\ k/m$, the mass has to be reduced while increasing spring constant. At the sacrifice of lower volume a conical actuator-bellows will help us achieve this goal.

The elimination of weld is of considerable importance.

A. Welding by nature (local melting) introduces flaws into the strong and oriented fibers of steel. Bellows undergo the largest stress at where their diaphragms join. Therefore the weakest regions of a welded bellows must undergo the largest stress. This is why the conventional bellows are limited.

B. When the diaphragms are mechanically locked together they are still relatively free from each other—they will minutely roll on each other as the bellows expands and contracts. This relative freedom dramatically reduces stress at where the diaphragms join.

C. Press, tool, and die are used to mechanically lock the diaphragms of an actuator-bellows together. This process by nature is faster and cheaper than welding.

I claim:

1. An internal combustion engine comprising: a crankshaft, a connecting rod secured at a first end to said crankshaft and adapted to bend in a plane orthogonal to an axis of said crankshaft, a top bellows secured between a cylinder head and a second end of said connecting rod wherein said top bellows defines a combustion chamber, and a bottom bellows secured between a crankcase and said second end of said connecting rod wherein said bottom bellows defines an air pumping chamber.

2. The internal combustion engine of claim 1 further comprising a suspension disk secured to said second end of said connecting rod and located directly between said bellows.

3. The internal combustion engine of claim 1 wherein said connecting rod has a zig-zag configuration.

4. The internal combustion engine of claim 1 further comprising intake and exhaust valve assemblies in said cylinder head, each assembly comprising a solenoid for moving a poppet valve and guide bellows for constraining the poppet valve to move linearly.

5. The internal combustion engine of claim 4 wherein said guide bellows bias the poppet valves to an open position and said solenoids are operable to close said poppet valves.

6. The internal combustion engine of claim 5 further comprising an air intake valve on said crankcase for communicating air to said air pumping chamber.

7. The internal combustion engine of claim 6 further a flap valve located on said crankcase proximate said bottom bellows for directing flow from said air pumping chamber to a passage around the periphery of said top and bottom bellows to said intake valve assembly.

8. The internal combustion engine of claim 4 further comprising control means for delivering pulse width modulated signals to selectively operate said intake and exhaust valve assemblies.

9. The internal combustion engine of claim 1 further comprising an engine casing surrounding said top and bottom bellows, an insulating wall surrounding the engine casing, and air circulation means for delivering cooling air to a space defined between said casing and said wall.

* * * * *